US005548310A

United States Patent [19]

Binnert et al.

[11] Patent Number: 5,548,310

[45] Date of Patent: Aug. 20, 1996

[54] AUTOMATIC POSITIONING OF WIPER BLADES IN AN INK JET PRINTER MAINTENANCE STATION

[75] Inventors: Thomas R. Binnert, Hammondsport; Michael Carlotta, Sodus, both of N.Y.

[73] Assignee: Xerox Corporation, Stamford, Conn.

[21] Appl. No.: 324,207

[22] Filed: Oct. 17, 1994

[51] Int. Cl.[6] ..... B41J 2/165

[52] U.S. Cl. ..... 347/33

[58] Field of Search ..... 347/22, 30, 32, 347/33, 42; 15/256.5

[56] References Cited

U.S. PATENT DOCUMENTS

| | | | |
|---|---|---|---|
| Re. 32,572 | 1/1988 | Hawkins et al. | 156/626 |
| 4,193,513 | 3/1980 | Bull, Jr. et al. | 222/1 |
| 4,364,065 | 12/1982 | Yamamori et al. | 347/28 |
| 4,571,599 | 2/1986 | Rezanka | 347/87 |
| 4,679,059 | 7/1987 | Dagas | 347/50 |
| 4,746,938 | 8/1988 | Yamamori et al. | 347/28 |
| 4,774,530 | 9/1988 | Hawkins | 347/63 |
| 4,849,774 | 7/1989 | Endo et al. | 347/56 |
| 4,853,717 | 8/1989 | Harmon et al. | 347/29 |
| 4,855,764 | 8/1989 | Humbs et al. | 347/31 |
| 4,947,190 | 8/1990 | Mizusawa et al. | 347/33 |
| 5,151,715 | 9/1992 | Ward et al. | 347/33 |
| 5,257,044 | 10/1993 | Carlotta | 347/32 |
| 5,300,958 | 4/1994 | Burke et al. | 347/28 |
| 5,432,539 | 7/1995 | Anderson | 347/33 |

FOREIGN PATENT DOCUMENTS

| | | | |
|---|---|---|---|
| 03-246052 | 11/1991 | Japan | 347/33 |

*Primary Examiner*—John E. Barlow, Jr.

[57] ABSTRACT

A maintenance station for an ink jet printer has a wiper blade cleaning assembly which contains two wiping blades releasably mounted in slots in a blade holder. The blade holder has two opposing extensions perpendicular to and positioned on opposite sides of the mounted blades. The blade holder is movably mounted in a fixed structural member of the maintenance station and is biased towards the ink jet printhead, which traverses past the cleaning assembly on a carriage to and from the maintenance station, by a resilient urging means, such as a foam or spring housed in a receptacle in the structural member. The blade holder extensions are parallel to each other and the direction of traversal by the printhead. The leading and training ends of the blade holder extensions are sloped for functioning as ramps or cams which slidingly engage the printhead as it moves past the wiper blade cleaning assembly and automatically positions the wiping blades relative the printhead to assure an appropriate interference or contact dimension of the distal ends with the blades by the printhead.

10 Claims, 5 Drawing Sheets

AUTOMATIC POSITIONING OF WIPER BLADES IN AN INK JET PRINTER MAINTENANCE STATION

BACKGROUND OF THE INVENTION

The present invention relates to wiper blade cleaning systems for nozzle faces of ink jet printheads, and more particularly, to automatic positioning of the dimension between the printhead nozzle face and the wiper blade holder to control the contact dimension of the distal ends of the wiper blades.

An ink jet printer of the so-called "drop-on-demand" type has at least one printhead from which droplets of ink are directed towards a recording medium. Within the printhead, the ink may be contained in a plurality of channels and energy pulses are used to cause the droplets of ink to be expelled, as required, from orifices at the ends of the channels.

In a thermal ink jet printer, the energy pulses are usually produced by resistors, each located in a respective one of the channels, which are individually addressable by current pulses to heat and momentarily vaporize ink in the channels which contact the resistors. Operation of a thermal ink jet printer is described in, for example, U.S. Pat. No. 4,849,774.

It has been recognized that there is a need to maintain the ink ejecting orifices of an ink jet printer, for example, by periodically cleaning the orifices when the printer is in use, and/or by capping the printhead when the printer is out of use or is idle for extended periods. The capping of the printhead is intended to prevent the ink in the printhead from drying out. There is also a need to prime a printhead before use, to ensure that the printhead channels are completely filled with ink and contain no contaminants or air bubbles. Maintenance and/or priming stations for the printheads of various types of ink jet printers are described in, for example, U.S. Pat. Nos. 4,855,764; 4,853,717 and 4,746,938 while the removal of gas from the ink reservoir of a printhead during printing is described in U.S. Pat. No. 4,679,059.

The priming operation for a printhead usually involves either forcing or drawing ink through the printhead nozzles, and this operation can leave some ink on the nozzle face of the printhead. A build-up of ink residue on the printhead face has a deleterious effect on print quality. It has also been found that paper fibers and other foreign material can also collect on the printhead face while printing is in progress and, like the ink residue, can also have a deleterious effect on print quality. U.S. Pat. No. 4,853,717 discloses that a printhead is moved across a wiper blade at the end of a printing operation so that paper dust, ink residue, and other contaminants are scraped off the nozzle face before the printhead is capped. U.S. Pat. No. 4,746,938 discloses an ink jet printer that provides a washing unit which, at the end of a printing operation, directs water at the nozzle face of the printhead to clean the nozzle face before it is capped.

U.S. Pat. No. 5,151,715 to Ward et al. discloses a printhead wiper for ink jet printers molded from an elastomer and including a wiping beam having a wiping edge formed at one end of the beam. The other end of the beam is integral with a base. A hole through the beam near the base decreases beam stiffness. A higher durometer elastomer may thus be used without applying excessive wiping force to the printhead. In another embodiment, the wiper includes a pair of wiping blades each of which have wiping edges for wiping a printhead traveling thereby. The first wipe removes pooled ink and debris and spread viscous ink while the second wipe furthers the spread of ink before it can retract to its former drop or pooled configuration.

U.S. Pat. No. 4,364,065 to Yamamori et al. discloses a nozzle moistening device to prevent clogging of the nozzle of an ink jet writing head, which includes an elastic enclosure fluid-tightly engageable with the front face of the writing head when not in use, a source of water, and a capillary tube for transmitting water from the source to the enclosure by capillary action to permit evaporation of water in the enclosure to moisten the nozzle.

U.S. Pat. No. 5,250,962 to Fisher et al. discloses a movable priming station for use with a full width array ink jet printhead. A support having a vacuum nozzle has the capability of being moved along the length of the printhead and adjacent the nozzle face thereof. The support is controlled so that the vacuum does not contact the nozzle face, when the support is moved. The support has members which slidingly contact the nozzle face, but the contact is not in the vicinity of the nozzles.

SUMMARY OF THE INVENTION

It is an object of the present invention to provide an automatically positionable blade cleaning device in an ink jet printer maintenance station for cleaning nozzle faces.

It is another object of the invention to provide at least one wiper blade in a movable blade holder having parallel extensions perpendicular to the wiper blade, the blade holder being resiliently urged by a resilient means in a direction towards the printhead nozzle face as the printhead slidingly moves therepast, so that the printhead slidingly contacts the blade holder extensions and depresses the blade holder in a direction opposite the direction of urging by the resilient means, thereby controlling the contact dimension of the distal end of the at least one wiper blade with the nozzle face.

In the present invention, two polyurethane wiping blades of unequal lengths, but otherwise identical, are releasably mounted in slots on a planar surface of a movable blade holder. The mounted blades are parallel and spaced apart a predetermined distance. The relative position of the blades is dependent on the order in which they must act on the nozzle face of the printhead as it leaves the priming station, so that the shorter blade cleans first. The shorter blade is stiffer because of its shorter length and serves to remove ink efficiently off of the printhead nozzle face. However, because of its stiffness, the shorter blade tends to chatter across the non-coplanar nozzle face and small amounts of ink collected on the shorter blade cleaning edge are deposited in crevices or other interfaces of adjacent discontinuities on the non-coplanar nozzle face. The longer blade is more compliant because of its added length and follows in the wake of the shorter blade to remove the last vestige of ink left by the stiffer, shorter blade.

For efficient cleaning, a predetermined minimum amount of contact is required by the distal ends of the wiper blades against the printhead nozzle face. The combined manufacturing tolerances for the printer, the cartridge bearing the printhead, and the maintenance station can easily exceed the required contact dimension between the distal ends of the wiper blade and the printhead nozzle face. Thus, the wiper blade holder is movably mounted in a fixed structural member and a resilient urging means, such as a spring or foam material urges the wiper blade holder towards the printhead nozzle face as the printhead is moved therepast.

Parallel extensions on the wiper blade holder perpendicularly extend from the surface containing the wiper blades and are located on opposite edges of the wiper blades and are generally perpendicular thereto. The extensions have a predetermined height, which is shorter than the wiper blades and the separation of the extensions enable the printhead to slidingly engage the extensions of the wiper blade holder, so that the printhead nozzle face is straddled and not contacted. The translating printhead engages the extensions of the wiper blade holder and moves the wiper blade holder in a direction opposite to the urging direction of the resilient urging means, thereby spacing the wiper blade holder surface containing the wiper blades a predetermined distance from the printhead nozzle face. Since the wiper blades extend a predetermined distance from the wiper blade holder surface, the exact interference dimension between the printhead nozzle face and the distal ends of the wiper blades is maintained.

The foregoing and other objects, features, and advantages of the invention will become more readily apparent from the following detailed description of a preferred embodiment wherein like index numerals indicate like parts.

DESCRIPTION OF THE PREFERRED EMBODIMENT

Figure 1:
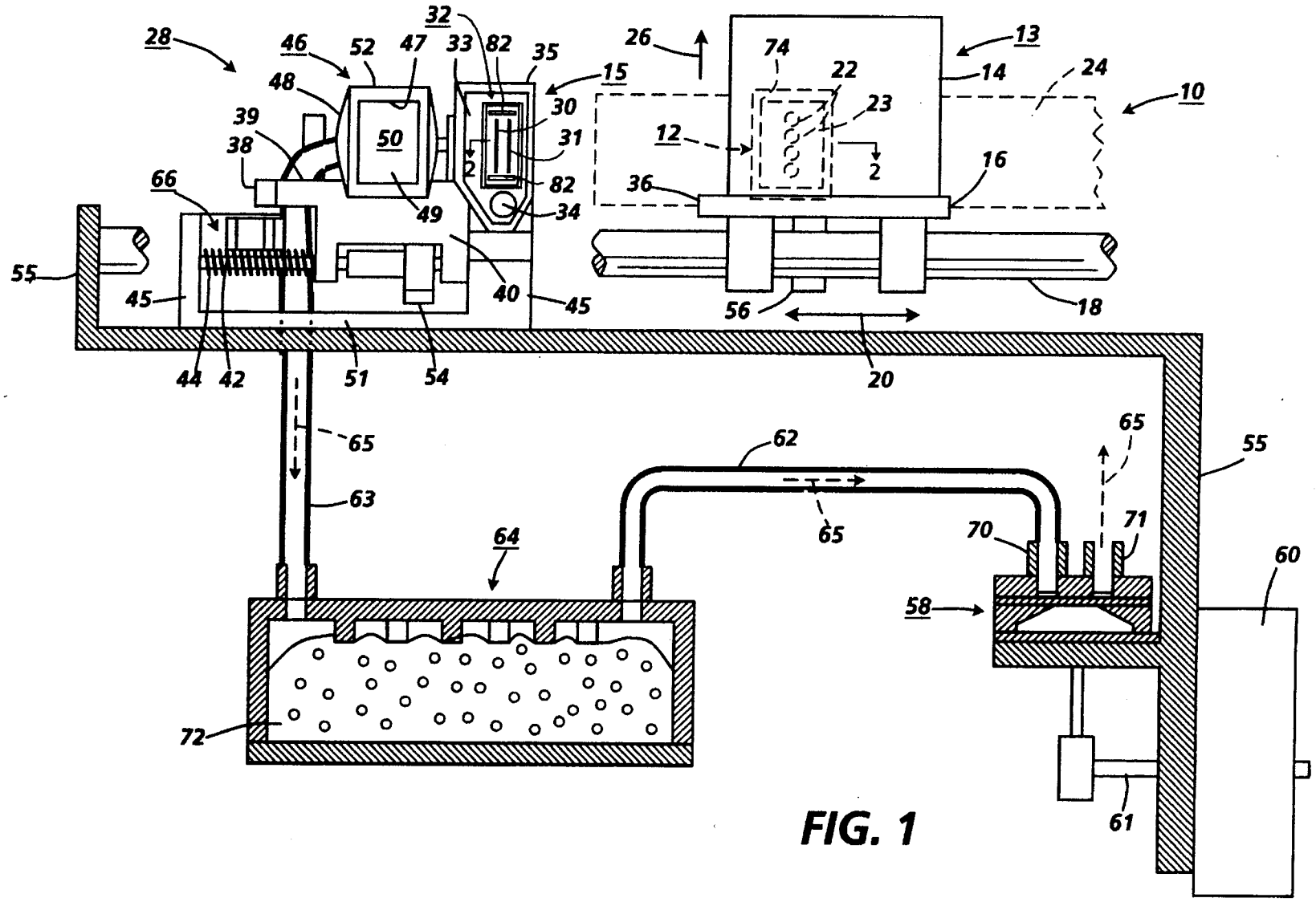
FIG. 1 is a schematic front elevation view of a partially shown ink jet printer having a maintenance incorporating the automatic positionable cleaning blade assembly of the present invention.

The printer 10 shown in FIG. 1 has a printhead 12, shown in dashed line, which is fixed to ink supply cartridge 14. The cartridge is removably mounted on carriage 16, and is translatable back and forth on guide rails 18 as indicated by arrow 20, so that the printhead and cartridge move concurrently with the carriage. The printhead contains a plurality of ink channels (not shown) which terminate in nozzles 22 in nozzle face 23 (both shown in dashed line) and carry ink from the cartridge to respective ink ejecting nozzles 22. When the printer is in the printing mode, the carriage translates or reciprocates back and forth across and parallel to a printing zone 24 (shown in dashed line) and ink droplets (not shown) are selectively ejected on demand from the printhead nozzles onto a recording medium (not shown), such as paper, in the printing zone, to print information thereon one swath at a time. During each pass or translation in one direction of the carriage 16, the recording medium is stationary, but at the end of each pass, the recording medium is stepped in the direction of arrow 26 for the distance of the height of one printed swath. For a more detailed explanation of the printhead and printing thereby, refer to U.S. Pat. Nos. 4,571,599 and Re. 32,572, incorporated herein by reference.

At one side of the printer, outside the printing zone, is a maintenance station 28. At the end of a printing operation or termination of the printing mode by the printer 10, the carriage 16 is first moved past the wiper blade cleaning assembly 15 of the present invention comprising two releasably mounted wiper blades 30, 31 in a movable blade holder 32, more fully discussed later, so that the printhead nozzle face 23 is wiped free of ink and debris every time the printhead and cartridge (hereinafter print cartridge 13) enters or exits the maintenance station. Adjacent the movable wiper blade holder, in the direction away from the printing zone and at a predetermined location along the translating path of the print cartridge, is a collection surface 33 in a fixedly mounted structural member 35. The carriage will position the print cartridge at this collection surface, sometimes referred to as a spit station or spittoon, after the print cartridge has been away from the maintenance station for a specific length of time, even if continually printing, because not all nozzles will have ejected enough ink droplets to prevent the ink or meniscus in the little used nozzles from drying and becoming too viscous. Accordingly, the print cartridge will be moved by, for example, a carriage motor (not shown) under the control of the printer controller (not shown) past the wiper blade assembly 32, cleaning the nozzle face, and to the predetermined location confronting the collection surface 33, whereat the printer controller causes the printhead to eject a number of ink droplets per nozzle therein. The collection surface is located within the structural member 35 and adjacent the movable blade holder 32. Ink deposited on the collection surface, which is substantially parallel to the printhead nozzle face and vertically oriented, is caused to move under the force of gravity towards the lower portion thereof, where an opening 34 is located for the ink to drain therethrough into a pad of absorbent material (not shown) behind the collection surface 33 of the structural member 35.

When the carriage 16 continues along guide rails 18 beyond the structural member 35 for a predetermined distance, the carriage actuator edge 36 contacts the catch 38 on arm 39 of the cap carriage 40. Cap carriage 40 has a cap 46 and is reciprocally mounted on guide rail 42 for translation in a direction parallel with the carriage 16 and print cartridge mounted thereon. The cap carriage is biased towards the structural member 35 by spring 44 which surrounds guide rail 42. The cap 46 has a closed wall 47 extending from a bottom portion 48 of the cap to provide an internal recess 49 having a piece of absorbent material 50 therein. The top edge of the wall 47 is covered by a resilient material to form a seal 52. The cap is adapted for movement from a location spaced from the plane containing the printhead nozzle face to a location wherein the cap seal intercepts the plane containing the printhead nozzle in response to movement by the cap carriage. After the carriage actuator edge 36 contacts the catch 38, the print cartridge carriage and cap carriage move in unison to a location where the cap is sealed against the printhead nozzle face. At this location, the cap closed wall surrounds the printhead nozzles and the cap seal tightly seals the cap recess around the nozzles. During this positioning of the cap against the printhead nozzle face, the cap carriage is automatically locked to the print cartridge by pawl 54 in cooperation with pawl lock edge 56 on the carriage 16. This lock by the pawl together with the actuator edge 36 in contact with catch 38 prevents relative movement between the cap 46 and the printhead nozzle face 23.

Once the printhead nozzle face is capped and the cap is locked to the print cartridge, the printer controller may optionally cause the printhead to eject a predetermined number of ink droplets into the cap recess 49 and absorbent material 50 therein for the purpose of increasing humidity in the sealed space of the cap recess.

A typical diaphragm vacuum pump 58 is mounted on the printer frame 55 and is operated by any known drive means, but in the preferred embodiment, the vacuum pump is operated by the printer paper feed motor 60 through motor shaft 61, since this motor does not need to feed paper during printhead maintenance, and this dual use eliminates the need for a separate dedicated motor for the vacuum pump. The vacuum pump is connected to the cap 46 by flexible hoses 62, 63 and an ink separator 64 is located intermediate the cap and vacuum pump.

The print cartridge 13, through engagement of the carriage actuator edge 36 and catch 38 of the cap carriage 40, will cause the printhead nozzle face 23 to be capped, but the tube 63 will not be pinched shut by pinch valve 66. This will be referred to as the capped position, and the nozzle face is subjected to humidified, ambient pressure air through the cartridge vent (not shown) and vacuum pump valves 70, 71 through separator 64. For more detailed information on the capping carriage of the nozzle face, which is not a part of this invention, refer to U.S. Pat. No. 5,257,044, which disclosure is incorporated herein by reference.

When it is necessary to prime the printhead, the carriage 16 containing the print cartridge is moved from the capped position towards fixed support member 45 which extends from base 51 removably attached to printer frame 55. At this location the pinch valve 66 closes flexible hose 63 by movement of the carriage 16. Paper feed motor 60 is energized and diaphragm vacuum pump 58 evacuates the separator 64, partially filled with an absorbent material, such as reticulated polyurethane foam 72, and connecting hoses 62, 63 to a negative pressure of about minus 120 inches of H2O as indicated by arrow 65. Meanwhile the cap recess 49 is still at ambient pressure because of the closure of hose 63 by pinch valve 66. After about 18 seconds, the carriage 16 and cap carriage 40 are returned to the location where the nozzle face is still capped, but the flexible hose 63 is no longer pinched closed; i.e., in the capped position. Spring 44 always biases the cap carriage away from support member 45, so when the print cartridge carriage 16 moves in a direction away from support member 45, the cap carriage follows. At this point, the cap is still sealed to the printhead nozzle face and the pinch valve is opened thereby subjecting the sealed cap internal recess to a negative pressure of minus 120 inches of H2O, which causes the suction removal of about 0.2 cc±0.05 cc of ink. After about one second, the carriage 16 then moves in a direction towards the printing zone, breaking the cap seal and stopping the priming. The cap pressure drops and returns to ambient. The print cartridge is moved by carriage 16 past the wiper blades 30, 31 in the cleaning assembly 15, to a hold position between the cleaning assembly and the printing zone 24 for a predetermined time period to wait while the ink and air are sucked or purged from the cap to the separator. When this has been accomplished, the carriage returns the print cartridge to the capped position past the cleaning assembly 15, so that the nozzle is cleaned again, to await for a printing mode command from the printer controller. Each time the print cartridge is moved past the wiper blade cleaning assembly 15, the contact dimension "Y" (see FIG. 2) or desired wiper blade interference is automatically achieved by the sliding engagement of the extensions 82 of blade holder 32, as discussed more fully later.

Figure 2:
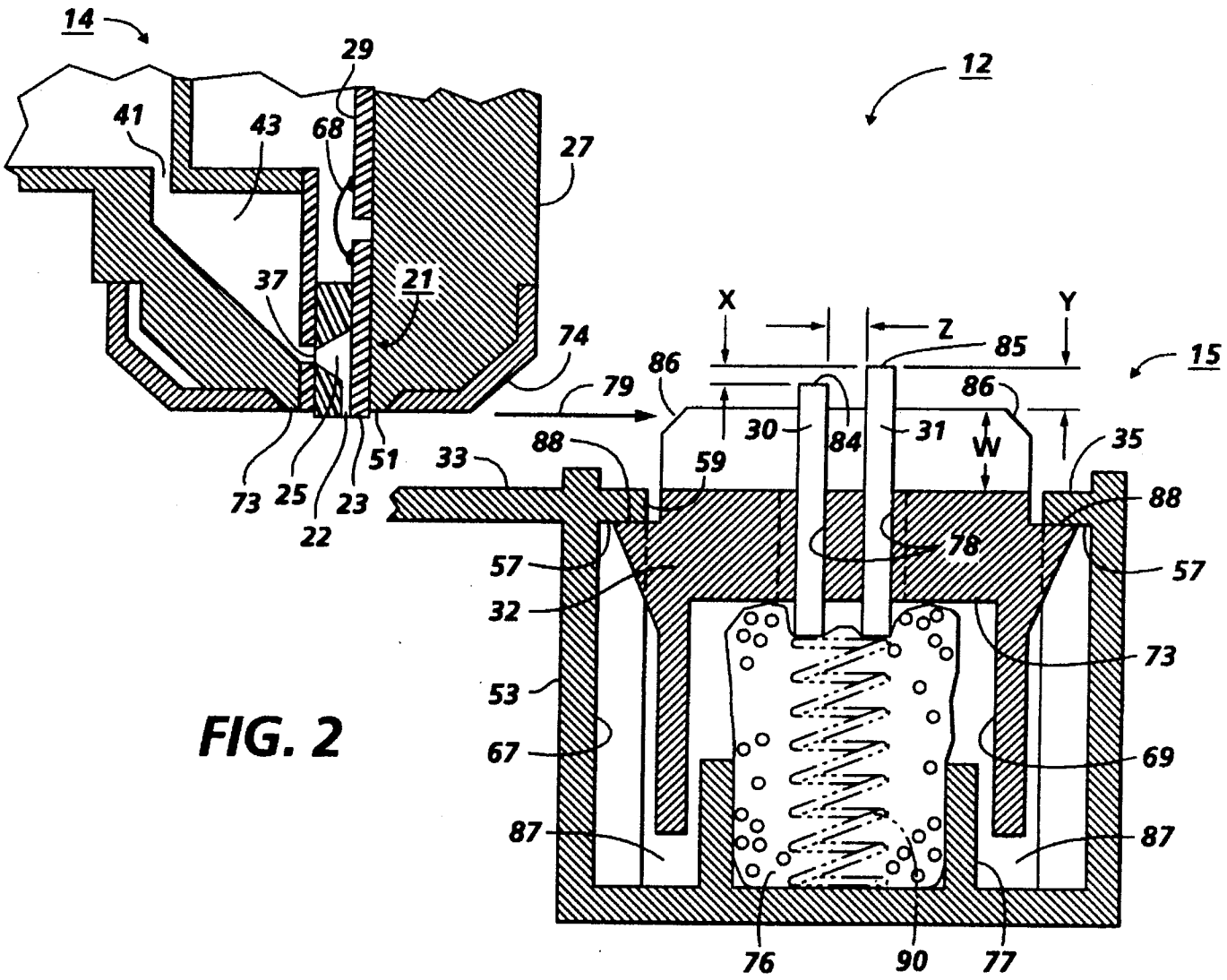
FIG. 2 is a cross-sectional view as viewed along section line 2—2 of FIG. 1, showing the printhead as it exits from a priming location and approaches the cleaning blade assembly of FIG. 1.

FIG. 2 is a cross-sectional view of a portion of the printhead 12 having the nozzle face 23 and wiper blade cleaning assembly 15, as viewed along section line 2—2 in FIG. 1, except that the printhead is shown returning from the capped location adjacent cap 46, where the printhead 12 may be primed, as indicated by arrow 79, instead of being located in the printing zone 24. The printhead comprises die module 21, heat sink 27, and printhead circuit board 29. The die module and printed circuit board are attached to a surface of the heat sink adjacent slightly spaced from each other. The die module has an ink supply reservoir 25 with inlet 37. The die module inlet is sealingly connected to the cartridge outlet 41 by cartridge passageway 43. The die module reservoir 25 is in communication with nozzles 22 in the printhead nozzle face 23. For a more detailed description of the die module refer to U.S. Pat. No. 4,774,530 to Hawkins, which is incorporated herein by reference. The die module heating elements (not shown) and driver circuitry (not shown) are electrically connected to the printer controller (not shown) through the printed circuit board 29 and by wire bonds 68 between the die module and printed circuit board. The printhead nozzle face 23, heat sink edge 51, and cartridge interface edge portion 73 are sealingly surrounded by a frame-shaped face plate 74, shown in FIG. 1 in dashed line. When a print cartridge 13 is primed, ink is left on the face plate and the surfaces surrounded by it; the surrounded surfaces include the printhead face, heat sink, and cartridge interface portion. The amount of ink left in this location and in particular on the nozzle face can be substantial. Left uncleaned, the ink in this location can smear on the recording medium, such as paper, and the result is unacceptable print quality. Also, ink left on the printhead face can dry and affect ink droplet directionality, another important print quality factor.

For efficient cleaning, a predetermined minimum amount of interference or contact is required between the distal ends 84, 85 of the wiper blades 30, 31, respectively, and the face plate 74, including the surfaces which it surrounds, as indicated by the dimension "Y". Manufacturing tolerances for the printer 10, including the print cartridge 13 and maintenance station 28, can easily exceed the required interference dimension "Y" for the wiper blades, so that the wiper blades have too much contact or not enough. To assure that the required amount of the distal ends of the wiper blades are available for cleaning the surface of interest, the wiper blades are removably mounted in a blade holder 32, and the blade holder is movably mounted in a receptacle 53 which is integral with fixed structural member 35 of the maintenance station 28. The blade holder is resiliently urged into contact with ledges 57 of the structural member 35 by a compression spring 90 (shown in dashed line) or a flexible foam 76, produced from a material such as reticulated polyurethane, as more fully described below. Alternatively, the compression spring could provide the urging of the blade holder 32 upward from the receptacle bottom wall 75, and could be surrounded by a foam 76 to absorb any ink removed by the upper blades and drained through the slots 78 in the blade holder.

The integral receptacle 53 is attached to the back side of the structural member 35 and to one side of the collection surface 33. An opening 59 in the structural member is aligned with the receptacle 53 but is smaller in dimension than the internal walls 67 of the receptacle, so that internal ledges 57 are formed. The bottom wall 75 of the receptacle 53 has upstanding walls 77 on the interior side of the bottom wall to hold the foam 76. The wiper blade holder 32 has an interior recess 69 with a floor 73. The floor thickness is about 2 mm. Slots 78 are formed through the floor 73 to receive replaceable wiper blades 30, 31 and have enlarged recesses 83 for the passage of ink removed by the wiper blades that tend to accumulate thereon and drain towards the blade holder. The flexible foam 76 absorbs the ink which passes through the slot recesses 83. The relatively small amount of ink draining into the foam 76 is dried leaving only the particulate matter of the ink, thereby having a large holding capacity and not requiring replacement by fresh foam very often. Notches 80 (see FIG. 5) on opposite edges of the wiper blades permit the releasable holding of the wiper blades and the ready replacement thereof in the slots of the blade holder 32. The wiper blades 30, 31 may be identical in size and shape, but in the preferred embodiment, the wiper blade 30, the one closer to the capping location or the cap 46 and cap carriage 40, is shorter, so that it is slightly stiffer. The wiper blade notches 80 in both wiper blades are located equal distances from the ends opposite the distal ends 84, 85 used for contacting and cleaning the printhead nozzle face, so that the end of the wiper blade 30 is a predetermined distance "X" shorter than the cleaning end of wiper blade 31. Distance X is preferably about 1 mm. In this wiping scheme, the shorter wiper blade 30 precedes the longer wiper blade 31 in its cleaning action when the print cartridge moves in a direction away from the capping location and towards the printing zone. The longer wiper blade 31 is more compliant because of its extra length and follows in the wake of the shorter blade 30 to remove substantially all of the residual ink in the vicinity of the face plate 74 and the surfaces surrounded thereby, including the nozzle face. Thus, the two blades 30, 31 compliment one another. The shorter, more efficient, stiffer blade 30 succeeds in removing the majority of the residual ink, and the longer, more compliant blade 31 has limited ink removal capability, but is superior in handling non-coplanar surfaces and, therefore, removes the ink that is left behind by the shorter blade through its conformability about surface discontinuities. The spacing "Z" between the wiper blades is about 3 mm, and the overall length of the shorter and longer blades above the wiper blade holder are about 5.0 and 5.5 mm, respectively. The blades are identical, except for their lengths, and have a thickness of abut 1.0 mm. The distance between the notches 80 of the wiper blades 30, 31 and, therefore, the length of the slots 78 in the wiper blade holder is about 16 mm. The depths of the notches 80 is about 1 to 1.2 mm, so that the distal ends 84, 85 of the blades are about 18 to 18.4 mm wide, thereby having a dimension to clean portions of the face plate and the surfaces of interest therebetween.

The wiper blade holder 32 has extensions 82 extending from opposite sides of the floor 73 and on the side of the floor 73 opposite the recess 69. The extensions are perpendicular to the wiper blades 30, 31 and slots 78 in which the blades reside. The height of the extensions are about 3 mm, as indicated by the dimension "W", and have sloping edges or ramps 86 on both sides of each extension 82, so that as the printhead 12 in print cartridge 13 travels past the wiper blades in the wiper blade holder, the extensions 82 slidingly engage the sides of the face plate 74 and slide thereacross, thus avoiding contact with the nozzle face and preventing damage to any delicate hydrophobic nozzle face coating. The resilient foam 76 exerts a force on the extensions 82, thus when the print cartridge contacts the ramp 86 of the extensions 82, the foam is squeezed by the blade holder 32 towards the bottom wall 75 of the receptacle 53. This action allows the extensions to space automatically the blade holder floor a predetermined distance from the nozzle face and assure the required interference dimension Y for appropriate cleaning action by the wiper blades on the printhead.

In FIG. 2, portions of the internal walls 67 are omitted, as indicated by numeral 87, to prevent unneeded weight, to enable the circulation of air therethrough to dry any ink in the foam 76, and to permit some flexibility of the walls 67 to aid in the installation of the blade holder 32 therein. The blade holder has at least two opposing flanges 88 for engaging the ledges 57 of the structural member 35 and the resilient foam 76 urges the blade holder's flanges against the ledges of the structural member.

Figure 3:
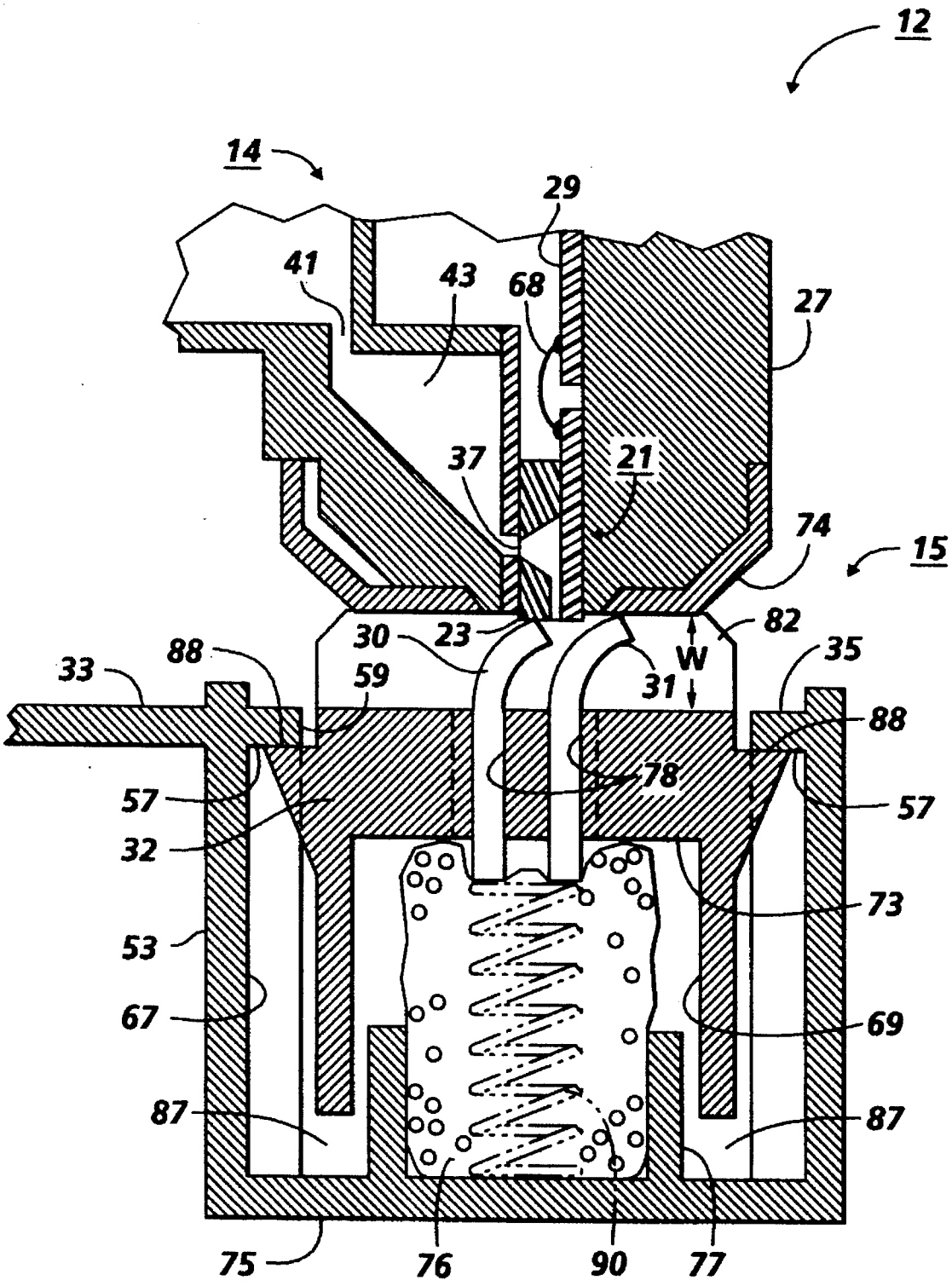
FIG. 3 is a view similar to that of FIG. 2, but showing the printhead nozzle face being cleaned by the cleaning blade assembly of FIG. 1.
Figure 4:
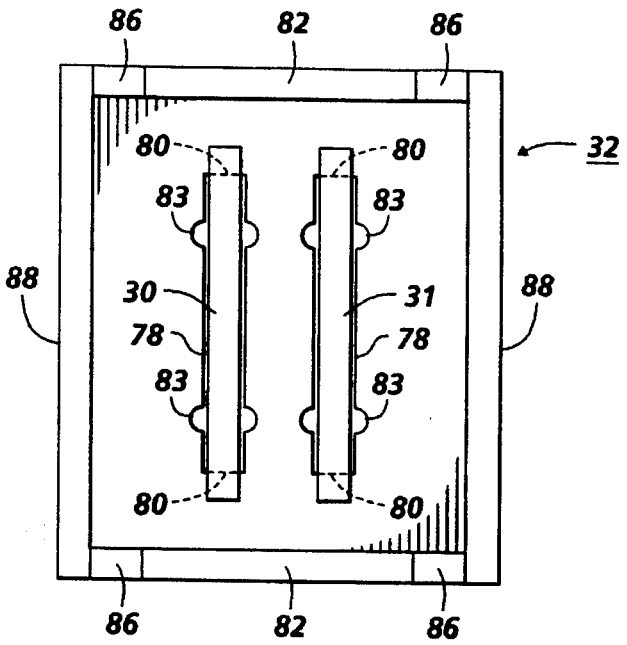
FIG. 4 is a plan view of the wiper blade holder of the cleaning blade assembly.
Figure 5:
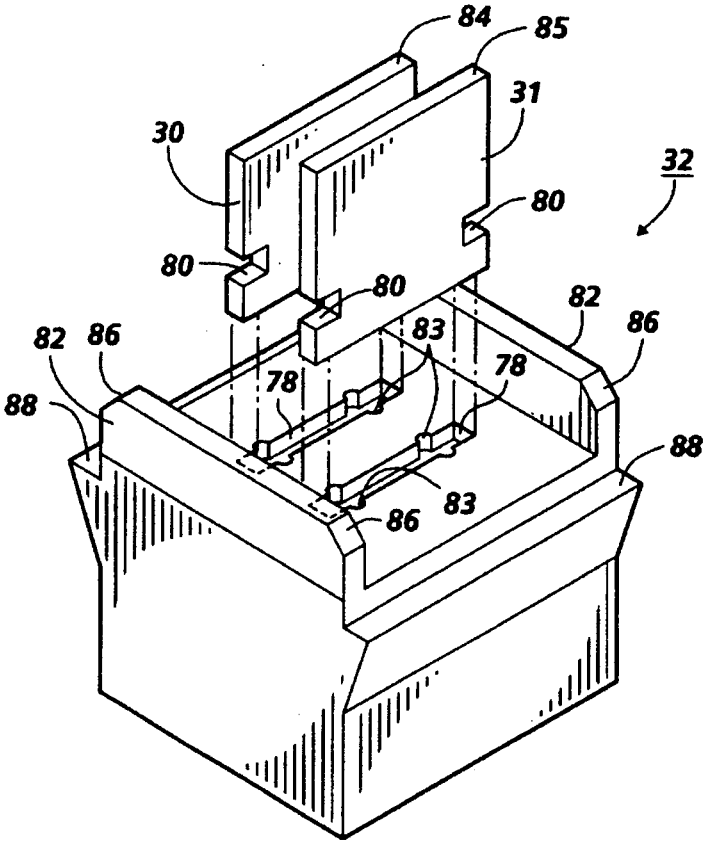
FIG. 5 is an exploded, isometric view of the wiper blade holder and wiper blades.

FIG. 3 shows the printhead 12 engaged with the extensions 82 of the blade holder 32, so that the height "w" of the extensions 82 provide the desired interference Y between the wiping blades and printhead 12 is maintained, even though there may be adverse tolerance buildups during the printer assembly. FIG. 4 is a plan view of the blade holder 32 and wiper blades 30, 31 and FIG. 5 is an isometric exploded view of the blade holder 32 with the wiper blades 30, 31 spaced from the slots 78 where the blades are replaceably held.

Figure 6:
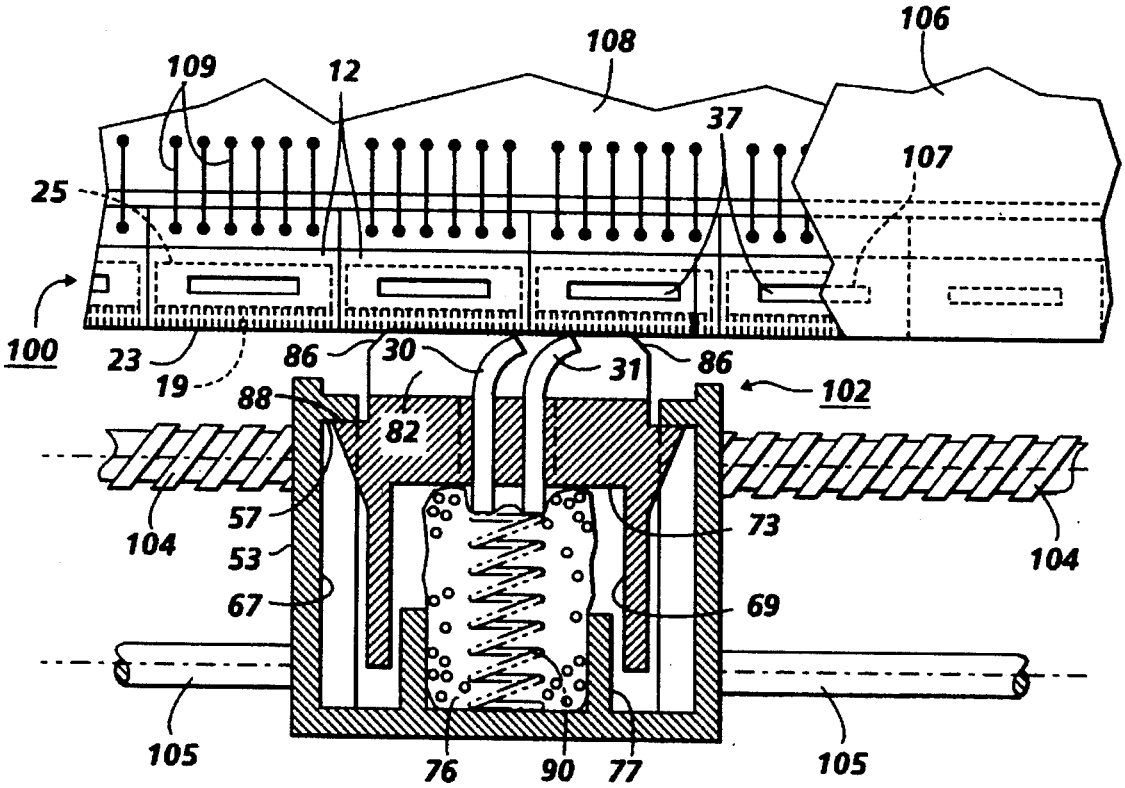
FIG. 6 is a partially shown, plan view of an alternate embodiment of the invention, showing the cleaning blade assembly of FIG. 1 mounted on a carriage for cleaning a full width array printhead.

FIG. 6 is a partially shown plan view of wiper blade cleaning system 15 adapted for cleaning a full width array ink jet printhead 100. The full width array printhead comprises an end-to-end assembly of individual printheads or subunits 12 which are bonded to one edge of a support structure (not shown) that also functions as a heat sink. A printed circuit board 108 is bonded to the support structure adjacent the array of printhead subunits 12 and electrically connected thereto by wire bonds 109. Each subunit has a reservoir 25 with inlet 37. The reservoir 25 is in communication with the subunit nozzles 22 by ink channels 19 shown in dashed line. A manifold 106 is mounted over the subunits and printed circuit board for supplying ink to the subunit inlets 37 by manifold outlets 107 aligned and sealed therewith. The cleaning system 15 is similar to that of FIGS. 2 and 3 except that the receptacle 53 is mounted on carriage 102 instead of fixed structural member 35. The carriage is translated back and forth across the nozzle face 23 of the full width array printhead by lead screw 104 and guide rail 105. The extensions 82 of the blade holder 32 contact the nozzle above and below the linear array of nozzles 22 and are slidingly moved therealong by the carriage 102 which is driven by the lead screw. A compression spring 90, shown in dashed line, or flexible foam 76 or both is housed in the receptacle 53 and urges the blade holder flanges 88 against the receptacle ledges 57. Thus, the blade holder extensions move slidingly along the printhead nozzle face 23 straddling the linear array of nozzles 22 therein in a manner similar to the movable priming station discussed in U.S. Pat. No. 5,250,962 to Fisher et al. which patent is incorporated herein by reference. Because the blade holder can move in a direction perpendicular to the direction of carriage translation, the blade holder extensions 82 in contact with the printhead nozzle face cause the blade holder 32 to be depressed and move in a direction which opposes the urging force of the spring 90 and/or foam 76. As discussed above, the distal ends of the wiper blades 30, 31 are automatically positioned by the blade holder for the desired contact dimension to assure adequate cleaning of the nozzle face 23.

Many modifications and variations are apparent from the foregoing description of the invention, and all such modifications and variations are intended to be within the scope of the present invention.

We claim:

1. A wiper blade cleaning assembly for cleaning the face of an ink jet printhead comprising:

a slotted blade holder for removably mounting at least one wiper blade in said slot, at least one blade having a distal end for slidingly engaging said printhead face passing thereby and resilient means for urging said blade distal end into a predetermined minimum contact with said printhead face, said resilient means comprising a flexible foam.

2. A wiper blade cleaning assembly in a maintenance station for a printhead in an ink jet printer, comprising:

a receptacle in a support member of the maintenance station, the receptacle having an opening therein and at least one ledge;

a resilient urging member housed in the receptacle;

a blade holder movably mounted in the receptacle, the blade holder having a surface with at least one slot therein, at least one extension, and at least one flange, the at least one flange being parallel to the at least one slot, the extension being substantially perpendicular to the at least one slot and having a predetermined dimension above the blade holder surface, the at least one extension having sloping opposing ends, said resilient urging member urging the blade holder flange against the receptacle ledge; and at least one wiper blade with a distal end, the at least one blade being removably mounted in the at least one blade holder slot, the wiper blade distal end being a predetermined distance above the blade holder surface, so that a printhead passing thereby will slidably engage the at least one extension which will automatically space the blade holder surface with said at least one slot therefrom and ensure that the distal end of the at least one wiper blade has a predetermined minimum contact with the printhead and wherein the resilient urging member is a flexible foam, said foam also absorbing the ink removed by wiper blade.

3. The cleaning assembly of claim 4, further including a compression spring surrounded by said flexible foam.

4. The cleaning assembly of claim 2, wherein the cleaning assembly has at least two wiper blades.

5. The cleaning assembly of claim 4, wherein the two wiper blades extend from the blade holder by different lengths.

6. The cleaning assembly of claim 5, wherein the support member is fixed in said maintenance station; and wherein the printhead has a plurality of nozzles in a nozzle face, the printhead being mounted on a movable carriage for concurrent movement therewith, the carriage translating the printhead to the maintenance station periodically and past the wiper blades in the blade holder.

7. The cleaning assembly of claim 6, wherein the support member is a translatable carriage; wherein the printhead has a full width array of nozzles in a nozzle face; and wherein the translatable carriage is translated by a drive means in a direction parallel to the printhead nozzle, so that the blade holder extensions straddle the full width array of nozzles and the wiper blades are automatically positioned to contact and clean the nozzle face region with the nozzles as the translatable carriage moves therealong.

8. The cleaning assembly of claim 2, wherein the receptacle has two parallel ledges; wherein the blade holder has two parallel extensions on opposite sides of the blade holder surface with the at least one slot therebetween and substantially perpendicular thereto; and wherein the blade holder has two flanges on opposite sides of the blade holder, the flanges being perpendicular to the extensions and being located on sides of the blade holder which are different from the blade holder sides having the extensions.

9. The cleaning assembly of claim 8, wherein the blade holder surface has two identical parallel slots therein; and wherein a wiper blade is removably installed in each slot.

10. The cleaning assembly of claim 9, wherein the wiper blades are identical except for their lengths, one wiper blade extends further from the blade holder surface than the other.

* * * * *